United States Patent [19]

Oleck et al.

[11] Patent Number: 4,510,043

[45] Date of Patent: Apr. 9, 1985

[54] PROCESS FOR DEWAXING OF PETROLEUM OILS PRIOR TO DEMETALATION AND DESULFURIZATION

[75] Inventors: Stephen M. Oleck, Moorestown; Robert C. Wilson, Jr., Woodbury, both of N.J.

[73] Assignee: Mobil Oil Corporation, New York, N.Y.

[21] Appl. No.: 580,924

[22] Filed: Feb. 16, 1984

[51] Int. Cl.[3] ..... C10G 65/02; C10G 45/64

[52] U.S. Cl. ..... 208/97; 208/210; 208/216 PP

[58] Field of Search ..... 208/97, 210, 216 PP

[56] References Cited

U.S. PATENT DOCUMENTS

| | | | |
|---|---|---|---|
| 4,153,540 | 5/1979 | Gorring et al. | 208/89 |
| 4,415,436 | 11/1983 | Angevine | 208/89 |
| 4,419,218 | 12/1983 | Angevine et al. | 208/59 |
| 4,419,271 | 12/1983 | Ward | 208/111 |
| 4,428,862 | 1/1984 | Ward et al. | 208/59 |
| 4,434,047 | 2/1984 | Hensley, Jr. et al. | 208/111 |
| 4,440,630 | 4/1984 | Oleck et al. | 208/111 |
| 4,443,329 | 4/1984 | Eberly, Jr. et al. | 208/111 |
| 4,448,677 | 5/1984 | Oleck et al. | 208/216 PP |

*Primary Examiner*—Delbert E. Gantz
*Assistant Examiner*—O. Chaudhuri
*Attorney, Agent, or Firm*—Alexander J. McKillop; Michael G. Gilman; Van D. Harrison, Jr.

[57] ABSTRACT

The catalytic demetalation and desulfurization of a residual oil is substantially improved by subjecting the residual oil to hydrodewaxing prior to the demetalation and desulfurization comprising prior to contacting the residual oil with demetalation and desulfurization catalysts, contacting the residual oil, under hydrodewaxing operating conditions effective to significantly reduce the pour point of the residual oil and to cause substantially little demetalization of the residual oil, with a catalyst comprising about 1 to about 10 weight percent of a Group VIB metal, the metals based on the total catalyst, and being present as the oxides or sulfides on a support comprising a composite of alumina and about 5 to about 25 weight percent of a ZSM-5 crystalline zeolite based on the total composite, the catalyst having at least 60 percent of its pore volume in the 50 to 200 Angstroms diameter range or at least 50% of the pore volume in the 30 to 100 Angstroms diameter range.

20 Claims, No Drawings

PROCESS FOR DEWAXING OF PETROLEUM OILS PRIOR TO DEMETALATION AND DESULFURIZATION

BACKGROUND OF THE INVENTION

1. Field of the Invention

This invention relates to a catalytic hydrocarbon conversion process for the dewaxing of residual oils prior to demetalation and desulfurization. More particularly, the invention relates to a catalytic multi-stage hydrocarbon conversion process for reducing high metals content, sulfur content and pour point of the catalytically-reacted residual oil by the use of a sequential combination of catalytic compositions which have been found to be especially effective for this purpose.

2. Description of the Prior Art

Residual petroleum oil fractions produced by atmospheric or vacuum distillation of crude petroleum are characterized by relatively high metals, high sulfur, high Conradson Carbon Residue (CCR) and high amounts of paraffinic wax-producing components. This comes about because practically all of the metals and CCR present remain in the residual fraction and a disproportionate amount of sulfur and paraffinic wax-producing components in the original crude oil also remains in that fraction. Principal metal contaminants are nickel and vanadium, with iron and small amounts of copper also sometimes present. Additionally, trace amounts of zinc and sodium are found in some feedstocks. The high metals and CCR content of the residual fractions generally preclude their effective use as charge stocks for subsequent catalyst processing such as catalytic cracking and hydrocracking. The metal contaminants deposit on the special catalysts for these cracking processes and cause the premature aging of the catalyst and/or formation of inordinate amounts of coke, dry gas and hydrogen. CCR, a measure of a molecule's tendency to coke rather than crack and/or distill, is also an undesirable property for charge streams processed by catalytic cracking. Under the high temperature employed in catalytic cracking, molecules high in CCR thermally and/or catalytically degrade to coke, light gases, and hydrogen.

It is current practice to upgrade certain residual fractions by a pyrolytic operation known as coking. In this operation the residuum is destructively distilled to produce distillates of low metals content and leaves behind a solid coke fraction that contains most of the metals. Coking is typically carried out in a reactor or drum operated at about 800° to 1100° F. temperature and a pressure of one to ten atmospheres. The economic value of the coke by-product is determined by its quality, especially its sulfur and metals content. Excessively high levels of these contaminants make the coke useful only as low valued fuel. In contrast, cokes of low metals content, for example up to about 100 ppm (parts-per-million by weight) of nickel and vanadium, and containing less than about 2 weight percent sulfur may be used in high valued metallurgical, electrical and mechanical applications.

Certain residual fractions are currently subjected to visbreaking, which is a heat treatment of milder conditions than used in coking, in order to reduce their viscosity and make them more suitable as fuels. Again, excessive sulfur content sometimes limits the value of the product.

Residual fractions are sometimes used directly as fuels. For this use, a high sulfur content is, in many cases, unacceptable for environmental reasons.

At present, catalytic cracking is generally done utilizing hydrocarbon charge stocks lighter than residual fractions which generally have an API gravity less than 20. Typical cracking charge stocks are coker and/or crude unit gas oils, vacuum tower overhead, etc., the feedstock having an API gravity from about 15 to about 45. Since these cracking charge stocks are distillates, they do not contain significant proportions of the large molecules in which the metals are concentrated. Such cracking is commonly carried out in a reactor operated at a temperature of about 800° to 1500° F., a pressure of about 1 to 5 atmospheres, and a space velocity of about 1 to 1000 WHSV.

The amount of metals present in a given hydrocarbon stream is often expressed as a charge stock's "metals factor". This factor is equal to the sum of the metals concentrations, in parts per million, of iron and vanadium plus ten times the concentration of nickel and copper in parts per million, and is expressed in equation form as follows:

$$Fm = Fe + V + 10(Ni + Cu)$$

Conventionally, a charge stock having a metals factor of 2.5 or less is considered particularly suitable for catalytic cracking. Nonetheless, streams with a metals factor of 2.5 to 25, or even 2.5 to 50, may be used to blend with or as all of the feedstock to a catalytic cracker, since charge stocks with metals factors greater than 2.5 in some circumstances may be used to advantage, for instance, with the new fluid cracking techniques.

In any case, the residual fractions of typical crudes will require treatment to reduce the metals factor. As an example, a typical Kuwait crude, considered of average metals constant, has a metals factor of about 75 to about 100. As almost all of the metals are combined with the residual fraction of a crude stock, it is clear than at least about 80% of the metals and preferably at least 90% needs to be removed to produce fractions (having a metals factor of about 2.5 to 50) suitable for cracking charge stocks.

Metals and sulfur contaminants would present similar problems with regard to hydrocracking operations which are typically carried out on charge stocks even lighter than those charged to a cracking unit. Typical hydrocracking reactor conditions consist of a temperature of 400° to 1000° F. and a pressure of 100 to 3500 psig.

It is evident that there is considerable need for an efficient method to reduce the metals and/or sulfur and/or CCR content of hydrocarbons, and particularly of residual petroleum fractions. While the technology to accomplish this for distillate fractions has been advanced considerably, attempts to apply this technology to residual fractions generally fail due to very rapid deactivation of the catalyst, presumably by metals contaminants and coke deposition.

U.S. Pat. No. 3,696,027 suggests sequentially contacting the feedstream with three fixed beds of catalysts having decreasing macroporosity along the normal direction of feed flow. "Macroporosity" denotes catalyst pores greater than about 500 Angstroms (A) in diameter. It is said to be strongly related to the capacity of catalyst particles to retain metals removed from a heavy hydrocarbon stream contaminated with organometallic compounds. The catalyst particles of the first bed of the '027 process have at least 30 vol. % macropores; the catalyst particles of the second bed have between 5 and 40 vol. % macropores; and the catalyst particles of the third bed have less than 5 vol. % macropores. The patent also teaches that the three fixed beds have progressively more active desulfurization catalysts along the normal direction of flow. The third catalyst bed (which contains the most active desulfurization catalyst) contains high surface area particles having an average pore diameter of at least 50 A, preferably at least 80 A, and more preferably at least 100 A, in order to lengthen the desulfurization run.

U.S. Pat. No. 3,730,879 discloses a two-bed catalytic process for the hydrodesulfurization of crude oil or a reduced fraction, in which at least 50% of the total pore volume of the first bed catalyst consists of pores in 100–200 A diameter range and in which less than 45% of the total pore volume of the second bed catalyst consists of pores in the 100–200 A diameter range. According to the '879 process, demetalation activity increases and desulfurization activity decreases along the normal direction of flow. The patent further suggests a two-catalyst-bed system with increasing average pore diameters and decreasing surface areas.

U.S. Pat. No. 3,766,058 also teaches a two-stage process for hydroprocessing a heavy hydrocarbon feedstock in which the second stage catalyst has a larger pore diameter than the first stage catalyst. Similar teachings are found in U.S. Pat. No. 3,830,720 and U.S. Pat. No. 4,048,060.

U.S. Pat. No. 3,876,530 discloses a multi-stage catalytic process for desulfurizing residual oils in which the initial stage catalyst has a relatively low proportion of hydrogenation metals and in which the final stage catalyst has a relatively high proportion of hydrogenation metals.

U.S. Pat. No. 3,931,052 suggests a two-stage process wherein the first stage catalyst has a strong selectivity for sulfur removal and the second stage catalyst has a strong selectivity for metals removal (U.S. Pat. No. 3,931,052 at col. 4, lines 32–43). The active desulfurization catalyst has at least 50% of its pore volume in the 30 to 100 A diameter range. The active demetalation catalyst has pores substantially distributed over a narrow 180 to 300 A diameter range (not less than 65% of the total pore volume is contained in pores having a diameter between 180 to 300 A).

U.S. Pat. No. 3,977,962 discloses a two-stage hydroconversion process using catalysts having certain pore sizes, surface areas and pore volumes. Both stages employ high surface area catalysts (200–600 $m^2/g$). The second stage catalyst generally has a smaller average pore diameter and surface area relative to the first stage catalyst.

U.S. Pat. No. 4,016,067 discloses a process for demetalation and desulfurization of petroleum oils in two stages with sequentially decreasing average pore diameters and increasing surface areas. The first catalyst has at least about 60% of its pore volume in 100–200 A pores, at least about 5% of its pore volume in pores greater than 500 A, and a surface area of up to about 110 $m^2/g$. The second catalyst has at least 50% of its pore volume in 30 to 100 A pores and a surface area of at least 150 $m^2/g$.

U.S. Pat. No. 4,054,508 discloses a three-stage process for demetalation and desulfurization of petroleum oils wherein the first and second stages contain catalysts as described in related U.S. Pat. No. 4,016,067 (supra) and the third stage comprises a second, smaller bed of the first stage catalyst.

U.S. Pat. No. 4,306,964 describes a catalytic-multistage process for removing metals, sulfur and CCR by contacting the oil sequentially with three of more catalysts having sequentially decreasing average pore diameters and sequentially increasing surface areas.

The processes in the above mentioned patents are satisfactory for the removal of metals, sulfur and CCR content from petroleum crude oils but a separate dewaxing is required to reduce the pour point of the resulting product. One approach to reduce the pour point of a petroleum crude oil is to isolate the desired lubricating stock from the crude oil by a set of subtractive unit operations which removes the unwanted components. The most important of these unit operations include distillation, solvent refining and dewaxing which are physical separation processes. Catalytic techniques are also available for dewaxing of petroleum stocks. A process of that nature developed by British Petroleum is described in The Oil and Gas Journal dated Jan. 6, 1975, at pages 69–73. See also U.S. Pat. No. 3,668,113.

In U.S. Pat. No. Re. 28,398 to Chen et al. is described a process for catalytic dewaxing with a catalyst comprising zeolite ZSM-5. Such a process combined with catalytic hydrofinishing is described in U.S. Pat. No. 3,894,938. U.S. Pat. No. 3,755,138 to Chen et al. describes a process for mild solvent dewaxing to remove high quality wax from a lube stock, which is then catalytically dewaxed to specification pour point. The entire contents of these patents are herein incorporated by reference.

U.S. Pat. No. 4,053,532 is directed towards a hydrodewaxing operation involving a Fischer-Tropsch synthesis product utilizing ZSM-5 zeolites.

U.S. Pat. No. 3,956,102 is connected with a process involving the hydrodewaxing of petroleum distillates utilizing a ZSM-5 zeolite catalyst.

U.S. Pat. No. 4,247,388 in the name of Banta et al. describes dewaxing operations utilizing ZSM-5 zeolites of specific activity.

U.S. Pat. No. 4,222,855 describes dewaxing operations to produce lubricating oils of low pour point and of high V.I. utilizing zeolites which includes ZSM-23 and ZSM-35.

U.S. Pat. No. 4,372,839 is directed to catalytically dewaxing a waxy distillate lubricating oil utilizing two different crystalline aluminosilicate zeolite catalysts of particularly defined characteristics.

In copending U.S. patent application Ser. No. 580,578 entitled "Multi-Stage Process For Demetalation, Desulfurization and Dewaxing of Petroleum Oils", filed by the same inventors and commonly assigned as the instant invention, there is described a process for the reduction of metals, sulfur and wax-producing components in residual oils. In this two stage process, the preferred catalyst in the first stage is cobalt-molybdenum on an alumina support containing larger pores (i.e., at least 65 percent of its pore volume is in the 150–300 Angstroms diameter range or at least 60% in the 100–200 Angstroms diameter range) than the pore size of the second catalyst. The preferred catalyst in the second stage is nickel-molybdenum on a composite of alumina and a minor amount of a ZSM-5 crystalline zeolite. The catalyst of the second stage has smaller pore sizes (i.e., at least 60 percent of its pore volume in the 50–200 Angstroms diameter range or at least 50% in the 30–100 Angstroms diameter range) than the catalyst in the first stage. Significant reductions of metals, sulfur and wax-producing components in the residual oil are achieved using this process.

In the present invention, there is provided a dewaxing process for residual oils which results in improvements in the subsequent demetalation and desulfurization of the residual oils.

SUMMARY OF THE INVENTION

The present invention relates to an improvement in the demetalation and desulfurization of residual oils. Specifically, the improvement relates to a dewaxing of the residual oil prior to demetalation and desulfurization by coventional means. The dewaxing is conducted with a desulfurization catalyst containing a minor amount of a crystalline zeolite known as an effective dewaxing catalyst. The dewaxing conditions, preferably including a relatively low operating pressure, are effective to dewax the residual oil while causing little if any demetalation. Not only is the pour point of the residual oil significantly reduced by this process, but it results in better demetalation and desulfurization in subsequent conventional hydrotreating.

This invention relates to improvements in a process for demetalation and desulfurization catalysts under hydrotreating conditions effective to significantly reduce the metals and sulfur contents of said residual oil, said improvement comprising:

prior to contacting said residual oil with demetalation and desulfurization catalysts, contacting said residual oil, under hydrodewaxing operating conditions effective to significantly reduce the pour point of said residual oil and to cause substantially little demetalization of said residual oil, with a catalyst comprising about 1 to about 10 weight percent of an iron group metal and about 5 to about 25 weight percent of a Group VIB metal, said metals based on the total catalyst, and being present as the oxides or sulfides on a support comprising a composite of alumina and about 5 to about 25 weight percent of a ZSM-5 crystalline zeolite based on the total composite, said catalyst having at least 60 percent of its pore volume in the 50 to 200 Angstroms diameter range or at least 50% of the pore volume in the 30 to 100 Angstroms diameter range.

DETAILED DESCRIPTION OF THE INVENTION

The hydrocarbon feed to the process of this invention can be a whole crude. However, since the high metal and sulfur components of a crude oil tend to be concentrated in the higher boiling fractions, the present process more commonly will be applied to a bottoms fraction of a petroleum oil, i.e. one which is obtained by atmospheric distillation of a crude petroleum oil to remove lower boiling materials such as naphtha and furnace oil, or by vacuum distillation of an atmospheric residue to remove gas oil. Typical residues to which the present invention is applicable will normally be substantially composed of residual hydrocarbons boiling about 650° F. and containing a substantial quantity of asphaltic materials. Thus, the charge stock can be one having an initial or 5 percent boiling point somewhat below 650° F., provided that a substantial proportion, for example, about 70 or 80 percent by volume, of its hydrocarbon components boils above 650° F.

The process of this invention dewaxes the processed feed under the general reaction conditions described below;

| | Broad Range | Preferred Range |
|---|---|---|
| Temperature, °F. | 500–900 | 600–800 |
| Pressure psig. | 100–2,000 | 200–600 |
| Space velocity L.H.S.V. (Volume of residual oil per volume of catalyst per hour) | 0.1–10.0 | 0.5–6.0 |
| Hydrogen Recirculation Rate, SCF/B (standard cubic feet of hydrogen per barrel of oil feed) | 500–15,000 | 800–8,000 |

These variables may be adjusted in known manner depending on the age of the catalyst and level of dewaxing required. For this invention, it is particularly preferred to use lower pressures, such as 200–600 psig. of the preferred range, since high pressure increases demetalation which will deactivate the catalyst more rapidly. Therefore, the hydrodewaxing conditions are selected to effectively reduce the pour point of the residual oil to the desired level while causing essentially little, if any, demetalation of the feed.

The support used in the catalyst can be produced using an alpha-alumina monohydrate as the source of alumina. The monohydrate referred to is sometimes characterized as boehmite based on its x-ray diffraction pattern. A particularly useful boehmite is that known as "Captapal SB", which is a very pure form of alumina manufactured and sold by the Conoco Chemicals Div. of Continental Oil Company. Another suitable alumina of the boehmite variety known as "SA" alumina marketed by the Kaiser Chemical Company. Both Catapal SB and SA are characterized by about 25 weight percent loss on ignition, with generally a slightly higher content of sodium and silica impurities for the SA variety.

The support of the catalyst in the dewaxing step is a blend of alumina and a ZSM-5 crystalline zeolite. The zeolite is present in amounts from about 5 to about 25 weight percent, preferably about 10 to about 20 weight percent of the total support. The blends can be extruded to form pellets and the pellets can be precalcined to stabilize the support at temperatures of about 1000° F. and above for about 0.5 to about 10 hours or longer, as required.

The ZSM-5 crystalline zeolites are well known and described in detail in U.S. Pat. No. Re. 28,398 to Chen et al. which is incorporated by reference herein. These crystalline zeolites have pore sizes of about 5 Angstrom units and are preferably formed as an aluminosilicate. The zeolites used in the instant invention can have the original cations associated therewith replaced with a wide variety of other cations according to techniques well known in the art. Typical replacing cations would include hydrogen, ammonium and metal cations including mixtures of the same. Of the replacing metallic cations, particular preference is given to cations of metals such as rare earth metals, manganese, calcium, as well as metals of Group II of the Periodic Table, e.g. zinc and Group VIII of the Periodic Table, e.g. nickel. Typical ion exchange techniques would be to contact the particular zeolite with a salt of the desired replacing cation or cations. Although a wide variety of salts can be employed, particular reference is given to chlorides, nitrates and sulfates. Representative ion exchange techniques are disclosed in U.S. Pat. Nos. 3,140,249; 3,140,251; and 3,140,253.

The method of preparing the catalyst with the hereinabove described supports may follow standard practice. The iron group metal (i.e. iron, cobalt or nickel, especially cobalt or nickel with nickel preferred) and Group VIB metal (i.e. molybdenum, tungsten or chromium with molybdenum particularly preferred) may be added by impregnation of the precalcined support with suitable salt solutions, followed by drying, calcination and, if necessary, presulfiding. The final catalyst composition comprises about 1 to about 10 weight percent of an iron group metal and about 5 to about 25 weight percent of a Group VIB metal all computed on the basis of total catalyst weight and on an anhydrous basis. The iron group metal and the Group VIB metal may be present in the final catalyst as the oxides or sulfides of the metals.

The catalyst used in this invention has a relatively small pore size and may be described by either of two parameters, i.e., having at least 60 percent of its pore volume in the 50 to 200 Angstroms diameter range or at least 50% of its pore volume in the 30 to 100 Angstroms diameter range. A catalyst meeting one but not necessarily both of these limitations may be employed in the subject hydrodewaxing process.

A preferred mode for operating the process of this invention in conjunction with a demetalation-desulfurization process is to provide a number of fixed catalyst beds in series with the dewaxing catalyst of the subject process as the first bed in the series followed by the demetalation catalyst bed and finally the desulfurization catalyst bed. Alternately, the series of catalysts can be located sequentially in a single bed. The former procedure is preferred particularly where the catalyst beds are provided in separate vessels which permits the operating conditions to be individually tailored to each catalyst so as to more easily achieve the desired change in the properties of the residual oil.

The hydrodewaxing process of this invention may be practiced in conjunction with known processes employed in the art for the demetalation and the desulfurization of residual oil such as those referred to herein in The Description of the Prior Art. For example, in one preferred embodiment, the process of the present invention is used in conjunction with the process disclosed in U.S. Pat. No. 4,016,067 to provide a dewaxed, demetalized and desulfurized residual oil by a three stage process where the residual oil flows serially through the stages. The first stage is the dewaxing stage of the present invention wherein the relatively small pore catalyst reduces the pour point of the residual oil. The second stage contains the relatively large pore catalyst of the '067 patent whose primary function is to demetalize the residual oil while the third stage contains the relatively small pore catalyst of the '067 patent whose primary function is to desulfurize the residual oil. In a particularly preferred embodiment, the first and third stage catalysts are substantially the same except for the presence of the zeolite in the first stage catalyst.

By practicing the dewaxing process of the present invention in the presence of an iron group metal and a Group VI B metal on a support of ZSM-5 and alumina, prior to demetalation-desulfurization, the pour point of the residual oil feed is markedly reduced and better demetalation-desulfurization is obtained in a subsequent conventional hydrotreating process. The depth of the pour point reduction achieved with a minor amount of ZSM-5 zeolite in the catalyst in the dewaxing, particularly at low pressure, is surprising and the improvement in the subsequent demetalation and desulfurization of the dewaxed residual charge is quite unexpected.

This invention is now illustrated by examples which are to be understood as not limiting on the scope of the invention, this scope being defined by the appended claims. All percentages refer to percentages by weight on an anhydrous basis unless specifically stated otherwise.

EXAMPLE 1

Preparation of Dewaxing Catalyst Support

A mixture comprising Kaiser SA alumina powder and dried ZSM-5 (15% NaZSM-5/85% $Al_2O_3$ on a dry basis) was blended with water and auger extruded into 1/32 inch diameter cylinders. These were dried and calcined at 1000° F., first in nitrogen and then in air. The calcined cylinders were exchanged with $NH_4NO_3$ solution to low sodium (0.01 wt %) and dried at 250° F. The solids content of the dried extrudate (1000° F. basis) was 86.4%.

EXAMPLE 2

Preparation of Dewaxing Catalyst

Two hundred fifty grams of the support of Example 1 were impregnated to incipient wetness with 163 ml. of a solution containing 57.7 grams of ammonium heptamolybdate (81.5% $MoO_3$) and dried at 250° F. The product was impregnated with 133 ml. of a solution containing 44.0 grams nickel chloride hexahydrate, dried at 250° F. and calcined at 1000° F. for 10 hours.

The catalyst prepared had the following properties:

| | |
|---|---|
| HZSM-5 content % | 15 |
| Metal Content, wt % | |
| NiO | 5 |
| $MoO_3$ | 17 |
| Density g/cc | |
| Packed | 0.67 |
| Particle | 1.14 |
| Real | 3.49 |
| Pore Volume, cc/g | 0.590 |
| Surface Area, $m^2/g$ | 199 |
| Avg. pore diameter, A | 119 |
| Pore Vol. Distribution % in Pores Of | |
| 0-30 A Diameter | 14 |
| 30-50 | 3 |
| 50-80 | 13 |
| 80-100 | 8 |
| 100-150 | 27 |
| 150-200 | 31 |
| 200-300 | 2 |
| 300+ | 2 |

EXAMPLE 3

Preparation of Support for Demetalation Catalyst 7000 grams of Captapal 5B alumina powder were mixed-mulled with about 4300 ml. of water and auger extruded to 1/32 inch diameter cylinders. The cylinders were oven dried at 250° F., calcined in flowing air for 10 hours at 1000° F. and then in stagnant atmosphere for four hours at 1700° F. to transform the alumina to the desired characteristics.

EXAMPLE α

Preparation of Demetalation Catalyst

About 700 grams of the calcined extrudates of Example 3 were impregnated to incipient wetness with 427 ml. of a solution containing 98.1 grams of ammonium heptamolybdate (81.5% $MoO_3$) and dried overnight in an oven at 250° F. The dried material was impregnated to incipient wetness with 281 ml. of a solution containing 110 grams of cobaltous nitrate hexahydrate and dried overnight at 250° F. The product was calcined at 1000° F. for 6 hours.

The resulting catalyst had the following properties:

| | |
|---|---|
| Metal Content, wt. % | |
| CoO | 3.7% |
| $MoO_3$ | 9.6% |
| Density, g/cc | |
| Particle | 1.27 |
| Real | 3.69 |
| Pore Volume, cc/g | 0.516 |
| Surface Area, $m^2/g$ | 112 |
| Average Pore Diameter, A | 184 |
| Pore Volume Distribution % in Pores Of | |
| 0–30 A Diameter | 6 |
| 30–50 | 1 |
| 50–80 | 2 |
| 80–100 | 6 |
| 100–150 | 22 |
| 150–200 | 55 |
| 200–300 | 2 |
| 300+ | 6 |

EXAMPLE 5

In the presence of the catalyst of Example 2, Lagomedio atmospheric residuum was hydroprocessed in a batch, one-liter bomb reactor at 500 psig, at 750° F., for 40 minutes using a 20/1 oil to catalyst weight ratio. This catalyst of nickel-molybdenum on a small pore alumina extrudate contained 15% H ZSM-5. The charge and product had the following properties:

| Product Properties | Charge | Product |
|---|---|---|
| Vanadium, ppm | 220 | 210 |
| Sulfur, Wt % | 1.99 | 1.87 |
| CCR, Wt % | 7.81 | — |
| Pour point, °F. | 75 | −10 |

At relatively low dewaxing pressure, the results indicate that the demetalation was low which is a positive result. Demetalation is an undesirable reaction in this operation because the metal deposits would rapidly deactivate this small pore catalyst. The pour point of the product was 85° F. lower than the charge, indicating substantial dewaxing.

EXAMPLE 6

Two hydrotreating runs were made in the presence of the catalyst of Example 4 in a batch one-liter bomb reactor at 2000 psig, at 750° F. for 80 minutes using a 20/1 oil to catalyst weight ratio. This catalyst was a cobalt-moleybdenum on large-pore alumina extrudate and is a typical demetalation component in a commercial system for hydrotreating residua.

The feed in the first run was the dewaxed product from Example 5 while the feed in the second run was the atmospheric residuum feed of Example 5. The results of these two runs are shown below:

| | Run No. 1 Dewaxed Charge | Run No. 2 Raw Charge |
|---|---|---|
| Product Properties | | |
| Vanadium, ppm | 80 | 92 |
| Sulfur, wt % | 1.20 | 1.32 |
| CCR, wt % | 5.9 | 5.8 |
| Pour Point, °F. | −20 | 65 |
| Overall Reductions* | | |
| Vanadium, % | 64 | 58 |
| Sulfur, % | 40 | 34 |
| CCR, % | 25 | 26 |
| Pour Point, °F. | 95 | 10 |

*Based on the raw residuum charge

The overall demetalation and desulfurization were 6% better with the combination of the Example 2 and Example 4 catalysts as compared to the demetalation catalyst of Example 4. Further, the pour point reduction with the combination of catalysts was 85° F. more than with only the demetalation catalyst.

Conventional desulfurization of the dewaxed-demetalized product of Run No. 1 with a small pore alumina desulfurization catalyst will provide a demetalized-desulfurized product having a substantially lower pour point than the product obtained from prior art demetalation-desulfurization processes.

What is claimed is:

1. In a process for demetalation and desulfurization of residual oil by contacting a residual oil with demetalation and desulfurization catalysts under hydrotreating conditions effective to significantly reduce the metals and sulfur contents of said residual oil, the improvement which comprises:

prior to contacting said residual oil with demetalation and desulfurization catalysts, contacting said residual oil, under hydrodewaxing operating conditions effective to significantly reduce the pour point of said residual oil and to cause substantially little demetalization of said residual oil, with a catalyst comprising about 1 to about 10 weight percent of an iron group metal and about 5 to about 25 weight percent of a Group VIB metal, said metals based on the total catalyst, and being present as the oxides or sulfides on a support comprising a composite of alumina and about 5 to about 25 weight percent of ZSM-5 crystalline zeolite based on the total composite, said catalyst having at least 60 percent of its pore volume in the 50 to 200 Angstroms diameter range.

2. The process of claim 1 wherein said iron group metal of the catalyst used is nickel.

3. The process of claim 1 wherein the Group VIB metal of the catalyst is molybdenum.

4. The process of claim 1 wherein the ZSM-5 crystalline zeolite in the catalyst is present in amounts from about 10 to about 20 weight percent based on the total composite.

5. The process of claim 4 wherein the ZSM-5 crystalline zeolite is HZSM-5 crystalline aluminosilicate zeolite.

6. The process of claim 5 wherein the iron group metal in the catalyst is nickel and the Group VIB metal is molybdenum.

7. The process of claim 1 wherein the dewaxing operating conditions include a pressure of about 200 to about 600 psig.

8. The process of claim 7 wherein the dewaxing operating conditions include a temperature of about 500° to about 900° F., a LHSV of about 0.1 to about 10 and a hydrogen recirculation rate of 500–15,000 SCF/B.

9. In a process for demetalation and desulfurization of residual oil by contacting a residual oil with demetalation and desulfurization catalysts under hydrotreating conditions effective to significantly reduce the metals and sulfur contents of said residual oil, the improvement which comprises:

prior to contacting said residual oil with demetalation and desulfurization catalysts, contacting said residual oil, under hydrowaxing operating conditions effective to significantly reduce the pour point of said residual oil and to cause substantially little demetalization of said residual oil, with a catalyst comprising about 1 to about 10 weight percent of an iron group metal and about 5 to about 25 weight percent of a Group VIB metal, said metals based on the total catalyst, and being present as the oxides or sulfides on a support comprising a composite of alumina and about 5 to about 25 weight percent of ZSM-5 crystalline zeolite based on the total composite, said catalyst having at least 50 percent of its pore volume in the 30 to 100 Angstroms diameter range.

10. The process of claim 9 wherein said iron group metal of the catalyst used is nickel.

11. The process of claim 9 wherein the Group VIB metal of the catalyst is molybdenum.

12. The process of claim 9 wherein the ZSM-%5 crystalline zeolite in the catalyst is present in amounts from about 10 to about 20 weight percent based on the total composite.

13. The process of claim 12 wherein the ZSM-5 crystalline zeolite is HZSM-5 crystalline aluminosilicate zeolite.

14. The process of claim 13 wherein the iron group metal in the catalyst is nickel and the Group VIB metal is molybdenum.

15. The process of claim 9 wherein the dewaxing operating conditions include a pressure of about 200 to about 600 psig.

16. The process of claim 15 wherein the dewaxing operating conditions include a temperature of about 500° to about 900° F., a LHSV of about 0.1 to about 10 and a hydrogen recirculation rate of 500–15,000 SCF/B.

17. The process of claim 1 wherein said iron group metal of the catalyst used is cobalt.

18. The process of claim 5 wherein the iron group metal in the catalyst is cobalt and the Group VIB metal is molybdenum.

19. The process of claim 9 wherein said iron group metal of the catalyst used is cobalt.

20. The process of claim 13 wherein the iron group metal in the catalyst is cobalt and the Group VIB metal is molybdenum.

* * * * *

UNITED STATES PATENT AND TRADEMARK OFFICE

CERTIFICATE OF CORRECTION

PATENT NO. : 4,510,043

DATED : April 9, 1985

INVENTOR(S) : Stephen M. Oleck et al

It is certified that error appears in the above-identified patent and that said Letters Patent is hereby corrected as shown below:

Col. 9, line 1, "α" should read --4--.

Col 10 (claim 1) line 51, Before "ZSM-5" insert --a--.

Col. 11 (claim 9) line 26, Before "ZSM-5" insert --a--.

Col. 12 (claim 12) line 3, "ZSM-%5" should read --ZSM-5--.

Signed and Sealed this

*Twenty-seventh* Day of *August 1985*

[SEAL]

*Attest:*

DONALD J. QUIGG

*Attesting Officer* *Acting Commissioner of Patents and Trademarks*